US009273511B2

(12) United States Patent
Wei

(10) Patent No.: US 9,273,511 B2
(45) Date of Patent: Mar. 1, 2016

(54) SHOWER DOOR ASSEMBLY WITH LINKAGE CONTROL

(71) Applicant: Ideal Sanitary Ware Co., Ltd, Guangdong (CN)

(72) Inventor: Wuxiang Wei, Guangdong (CN)

(73) Assignee: IDEAL SANITARY WARE CO., LTD., Guangdong (CN)

( * ) Notice: Subject to any disclaimer, the term of this patent is extended or adjusted under 35 U.S.C. 154(b) by 0 days.

(21) Appl. No.: 14/252,113

(22) Filed: Apr. 14, 2014

(65) Prior Publication Data

US 2015/0191962 A1 Jul. 9, 2015

(30) Foreign Application Priority Data

Jan. 3, 2014 (CN) ..... 2014 1 0002366

(51) Int. Cl.

| | |
|---|---|
| ***E06B 1/52*** | (2006.01) |
| ***E06B 1/60*** | (2006.01) |
| ***A47K 3/00*** | (2006.01) |
| ***A47K 3/30*** | (2006.01) |

(52) U.S. Cl.

CPC ... *E06B 1/52* (2013.01); *A47K 3/30* (2013.01); *E06B 1/60* (2013.01); *A47K 2003/307* (2013.01)

(58) Field of Classification Search

CPC ..... E06B 1/52; E06B 1/60; E06B 1/603; E04F 21/0007; E04F 21/1877; A47K 2003/307; A47K 3/36

USPC ..... 49/504, 505; 4/557, 607; 52/126.1, 52/126.3

See application file for complete search history.

(56) References Cited

U.S. PATENT DOCUMENTS

| | | | | | |
|---|---|---|---|---|---|
| 1,496,525 | A * | 6/1924 | Coco | 52/217 |
| 1,750,921 | A * | 3/1930 | Bright | 52/217 |
| 2,739,674 | A * | 3/1956 | Casebolt | 49/505 |
| 2,768,410 | A * | 10/1956 | Woodard | 52/204.56 |
| 2,856,040 | A * | 10/1958 | Dansereau | 49/408 |
| 3,553,891 | A * | 1/1971 | Casebolt | 49/505 |
| 4,453,346 | A * | 6/1984 | Powell et al. | 49/404 |
| 4,720,876 | A * | 1/1988 | Tomei et al. | 4/614 |
| 5,063,638 | A * | 11/1991 | Howard et al. | 16/238 |
| 5,918,659 | A * | 7/1999 | Lee | 160/199 |
| 5,992,100 | A * | 11/1999 | Sidney | 49/505 |
| 6,035,460 | A * | 3/2000 | Borter | 4/607 |
| 6,152,080 | A * | 11/2000 | Allen | 119/452 |
| 6,357,953 | B1 * | 3/2002 | Ballantyne | 403/43 |
| 6,792,721 | B1 * | 9/2004 | Montanari | 52/35 |
| 7,987,637 | B2 * | 8/2011 | Smith | 52/126.1 |
| 8,733,026 | B1 * | 5/2014 | Wei | 49/505 |
| 2002/0157318 | A1 * | 10/2002 | Teubert et al. | 49/360 |

(Continued)

FOREIGN PATENT DOCUMENTS

CN 203308298 * 11/2013

*Primary Examiner* — Katherine Mitchell
*Assistant Examiner* — Justin Rephann
(74) *Attorney, Agent, or Firm* — Pearne & Gordon LLP

(57) ABSTRACT

A shower door assembly with linkage control comprising a stationary frame, a movable frame and an adjustment assembly disposed between the stationary frame and the movable frame. The adjustment assembly comprises at least two adjustment devices and locking devices for locking each of the adjustment devices. Each of the locking devices comprises a locking element and a guiding device along which the locking element can slide. An actuating arm is provided to release and lock adjustment devices all at once. Therefore, it is unnecessary to adjust each of the adjustment devices separately, facilitating the operation of adjustment.

10 Claims, 11 Drawing Sheets

(56) References Cited

U.S. PATENT DOCUMENTS

2003/0019030 A1* 1/2003 Kopacz et al. ..... 4/607
2008/0229675 A1* 9/2008 Self et al. ..... 52/35
2009/0120004 A1* 5/2009 Cobb ..... 49/381
2014/0115773 A1* 5/2014 Wei ..... 4/607
2014/0250795 A1* 9/2014 Wei ..... 49/505
2014/0331565 A1* 11/2014 Wei ..... 49/505

* cited by examiner

SHOWER DOOR ASSEMBLY WITH LINKAGE CONTROL

CROSS-REFERENCE TO RELATED APPLICATION

The present invention claims priority from Chinese invention application No. 201410002366.2 filed on Jan. 3, 2014 in the name of Ideal Sanitary Ware Co., Ltd, the entire disclosure of which is herein incorporated by reference.

FIELD OF THE INVENTION

The present invention relates to a shower door, and in particular, to an adjustment assembly useful for the shower door, which achieves linkage control.

BACKGROUND OF THE INVENTION

Doors used for shower enclosure are often mounted against wall surfaces and the doors thus mounted are kept as vertical as possible. However, the wall surfaces of buildings are often not exactly vertical, for example, titled toward outside/inside by an angle. Therefore, if mounted completely along the wall surface, the doors may not be smoothly opened or closed. In this regard, it is necessary to adjust the distances between the top/bottom end of a door and a wall surface so as to keep the door in a vertical position.

To achieve this adjustment, a door assembly usually comprises a stationary frame to be attached to a wall surface, and a movable frame connected with a door panel, such as a glass door panel. The stationary frame is firstly attached to the wall surface and then the movable frame is moved toward the stationary frame, during which the distances between the top and bottom ends of the movable frame, and the stationary frame are such adjusted that the movable frame is in a vertical position, and thus so is the door panel. The stationary and movable frames are finally connected to each other by drilling thereon and by using fasteners.

However, in one aspect, the drilling operation requires at least two people to cooperate and is very time-consuming. In another aspect, the drilling may inadvertently cause damages to the surfaces of the frames (generally made of aluminum materials), which is undesirable to consumers.

In an aim to solve these problems, it was proposed solutions that do not involve drilling, by incorporating adjustment assemblies in the door assembly. However, when the relative distance between the stationary and movable frames needs to be changed, it is necessary to operate each of the adjustment assemblies separately. Further, the adjustment of the relative distance is normally achieved by the change of the engagements between teeth, so the minimum adjustment depends on the space between two adjacent teeth. If more precise adjustment is needed, the conventional solutions will not suffice. Moreover, these solutions require forming teeth on different components, causing increased complexity and cost for manufacture.

SUMMARY OF THE INVENTION

An object of the invention is to provide a shower door assembly that does not need drilling when assembling and can achieve linkage control of all of adjustment devices.

In one embodiment, a shower door assembly with linkage control is provided, the shower door assembly comprises a stationary frame, a movable frame and an adjustment assembly disposed between the stationary frame and the movable frame, the adjustment assembly comprising at least two adjustment devices and locking devices for locking each of the adjustment devices, wherein each of the locking devices comprises a locking element having an upper locking portion and a lower locking portion, the upper and lower locking portions each comprising a first through hole and a second through hole in communication with the first through hole, the first through hole having a dimension greater than or equal to a dimension of an end surface of corresponding adjustment device, the second through hole having a dimension smaller than the dimension of the end surface of the corresponding adjustment device, the upper locking portion further comprising a upper securing portion and an actuating arm, the actuating arm passing through the upper securing portion, the lower locking portion further comprising a lower securing portion and a fixing element, the fixing element passing through the lower securing portion; and a guiding device having an upper guiding element and a lower guiding element, the upper guiding element comprising a first guiding slot along which the locking element is able to slide, a supportive platform for supporting the actuating arm, a first cavity for receiving one of the at least two adjustment devices, and a carrying platform for carrying the upper securing portion of the locking element, the lower guiding element comprising a second guiding slot along which the locking element is able to slide, a second cavity for receiving other of the at least two adjustment devices, an elastic element for providing elastic force when pressed against the lower securing portion, and a third cavity located lower with respect to the second cavity and having the elastic element received therein, the fixing element passing through the lower securing portion and the elastic element and fixing to an upper wall of the third cavity.

In one embodiment, the upper and lower locking portions form in one piece. In another embodiment, the upper and lower locking portions detachably connected to each other by a linkage element.

In one embodiment, the locking element further comprises one or more intermediate locking portions, each of the intermediate locking portions comprising a first through hole and a second through hole in communication with the first through hole, the first through hole having a dimension greater than or equal to a dimension of an end surface of corresponding adjustment device, the second through hole having a dimension smaller than the dimension of the end surface of the corresponding adjustment device. Correspondingly, the guiding device further comprises one or more intermediate guiding elements, each preferably having same structures as the upper guiding element.

In one embodiment, each of the upper locking portion, the lower locking portion and the possible intermediate locking portion(s) further comprises a third through hole in communication with the first through hole and symmetrically disposed with respect to the second through hole about the first through hole. The third through hole has a dimension smaller than the dimension of the end surface of the corresponding adjustment device. The third through hole preferably has same dimension as that of the second through hole.

In one embodiment, each of the adjustment devices comprises an adjustment element and a carrier element bearing the adjustment element. The adjustment element has smooth side surfaces exposed for engaging with the locking device.

In one embodiment, the carrier element comprises connection wings for connecting to the movable frame, an upper loading frame connecting to the connection wings, a lower loading frame in parallel with the upper loading frame and in connection with the connection wings, and an opening which, together with the upper and lower loading frames, defines a space for receiving the adjustment element.

In one embodiment, the carrier element further comprises a front blocking plate connecting with the free ends of the upper and lower loading frames respectively, in order to prevent the adjustment element from moving outside the space.

In one embodiment, the adjustment element further comprises end surfaces, a top surface and a bottom surface, with one of the end surfaces in contact with the front blocking plate. At least one of the top and bottom surfaces is provided with a sliding groove. Correspondingly, a portion of at least one of the upper and lower frames forms a guiding rail for engaging within the sliding groove such that the adjustment element can be stably received within the space.

In one embodiment, the adjustment element is not provided with the sliding groove, but instead, the adjustment element has a height preferably greater, more preferably slightly greater, than a height of the opening, such that the adjustment element can be received in the space by virtue of its flexibility.

In one embodiment, the adjustment element has a length equal to or slightly smaller than that of the space.

By operation of the actuating arm, the adjustment devices can be locked or released all at once, without the need of operating the adjustment devices one by one. Therefore, a linkage control of the adjustment assembly is achieved. In addition, the locking devices are able to lock the adjustment element at any position along the side surfaces of the adjustment element, such that the relative distance of the stationary and movable frames can be adjusted continuously.

Elements that are irrelevant to the spirit of the invention are omitted from the drawings for the purpose of clear illustration of the invention.

DETAILED DESCRIPTION OF THE INVENTION

The invention will be described in more detail by the following examples in reference to the accompanied drawings.

Figure 1:
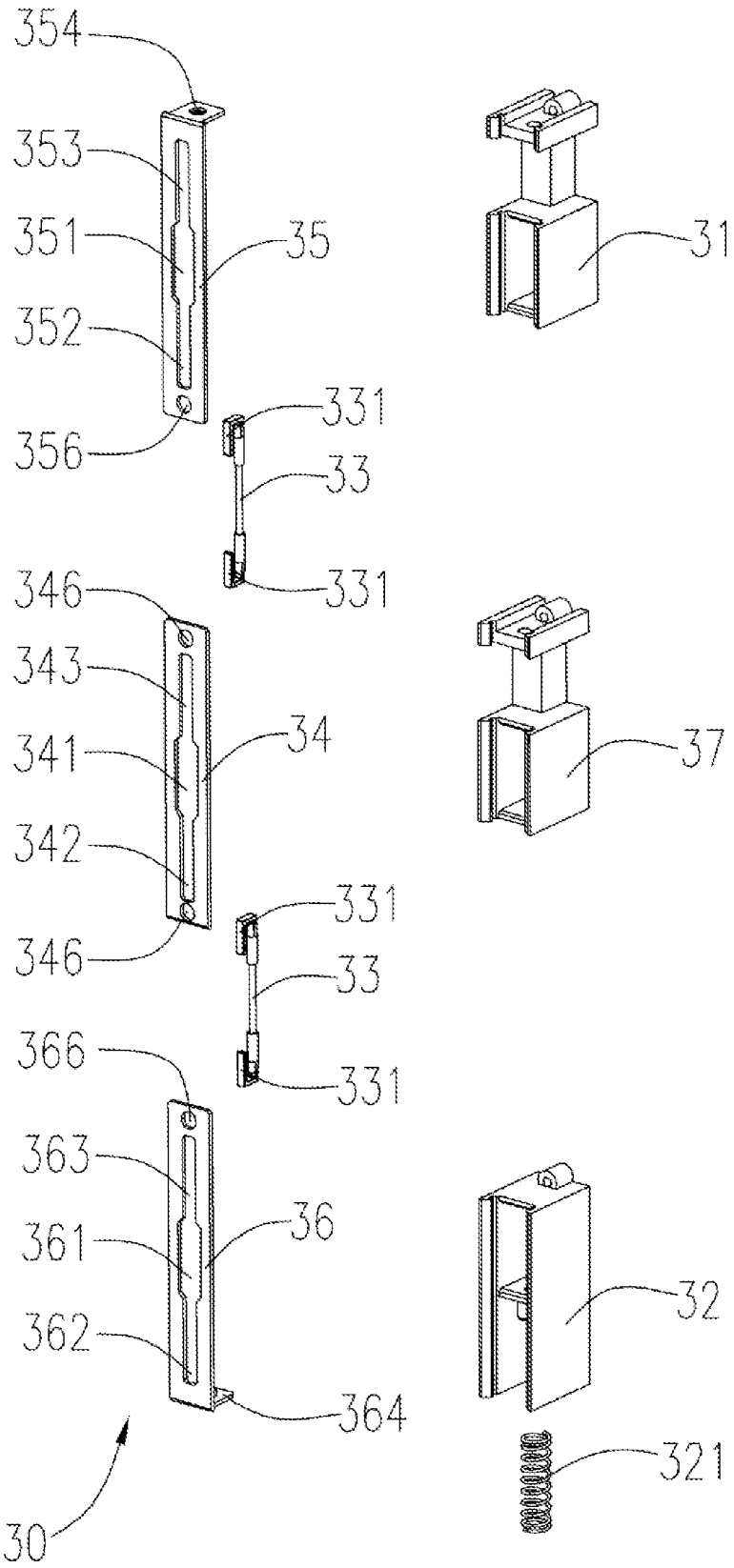
FIG. 1 shows an exploded view of an exemplary locking device, wherein some parts are omitted for clarity purpose.

FIG. 1 shows a locking device according to one example of the invention. The locking device comprises a locking element 30 and guiding devices 31, 32, which are cooperated to lock an adjustment element 10.

In the example, the locking element 30 comprises a upper locking portion 35 and a lower locking portion 36, with each of the locking portions comprises a first through hole 351, 361 and a second through hole 352, 362 in communication with the first through hole. The first through hole 351, 352 has a dimension greater than or equal to that of an end surface 102 of the adjustment element 10. The second through hole 352, 362 has a dimension less than that of the end surface 102. Therefore, the adjustment element 10, which is disposed on a carrier element 20, can pass through the first through hole 351, 352, but not the second through hole 352, 362.

The locking element 30 further comprises an upper securing portion 354 at the upper locking portion 35, a lower securing portion 364 at the lower locking portion 36, an actuating arm 40 (FIG. 11) passing through the upper securing portion 354, and a fixing element 329 (FIG. 5) passing through the lower securing portion 364.

In the example, the upper and lower locking portions 35, 36 are detachably connected by a linkage element 33. The detachable connection can be achieved by a number of methods known in the art. In the present example, linkage holes 356, 366 are respectively provided to the upper and lower locking portions 35, 36, and are connected to hooks 331 provided at both ends of the linkage element 33, such that the upper and lower locking portions 35, 36 are connected.

Figure 7:
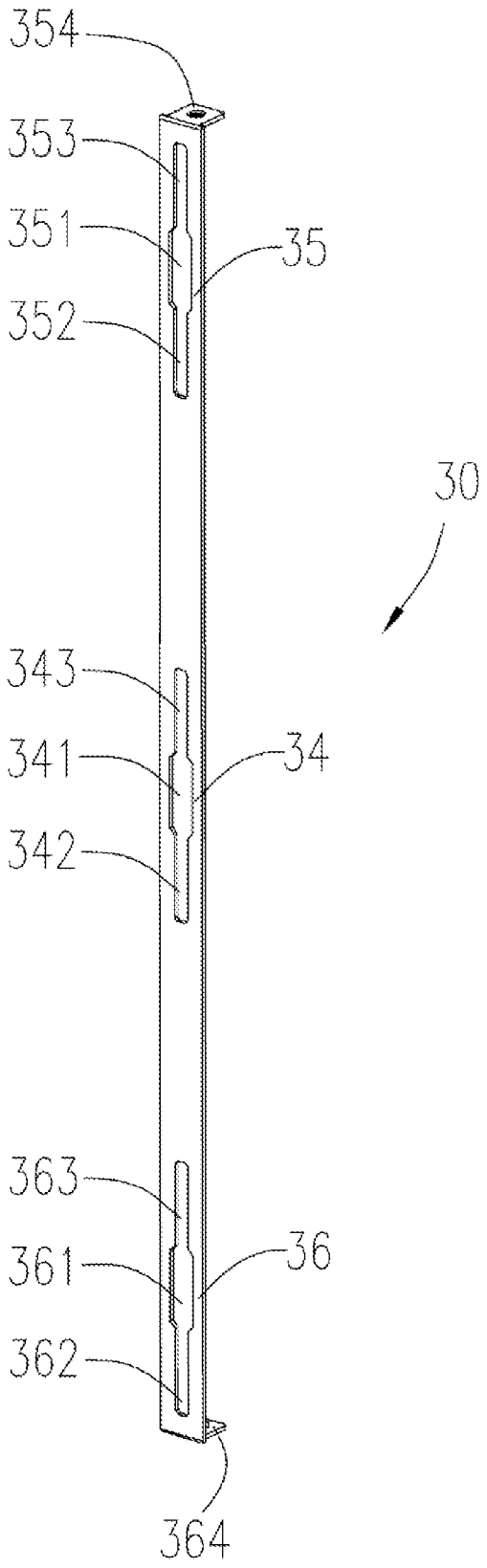
FIG. 7 shows another example of locking element.

In other examples, the upper and lower locking portions 35, 36 are form in a single piece, as shown in FIG. 7. In this situation, no linkage element 33 is necessary.

Figure 2:
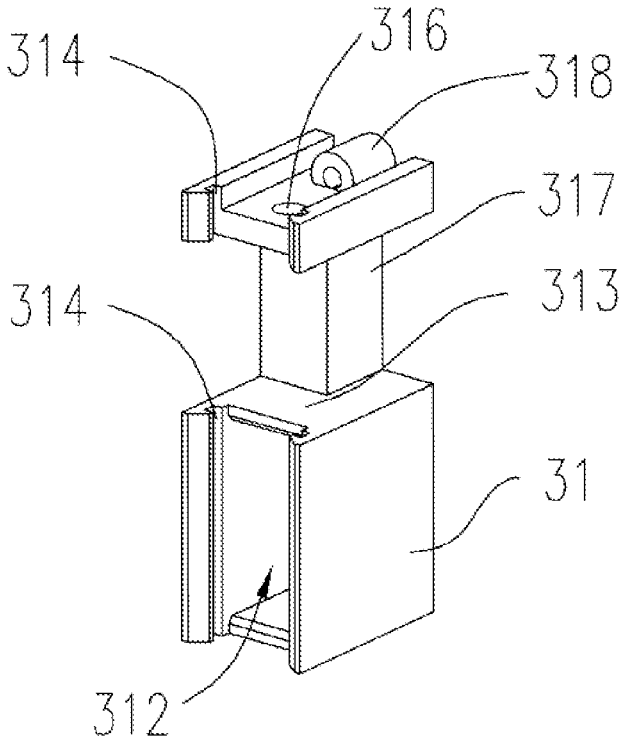
FIG. 2 shows a schematic view of an exemplary upper guiding element.
Figure 3:
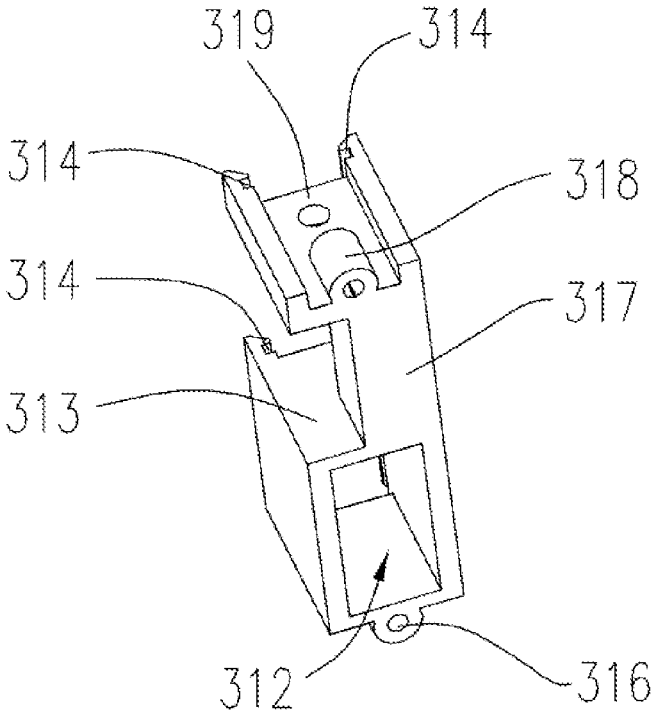
FIG. 3 is a rear view of the upper guiding element as shown in FIG. 2.

With reference again to FIG. 1, the guiding device comprises an upper guiding element 31 and a lower guiding element 32. As shown in more detail in FIGS. 2 and 3, the upper guiding element 31 comprises a first guiding slot 314 along which the locking element 30 is able to slide; a supportive platform 313 for supporting the actuating arm 40; a first cavity 312 for receiving one of the adjustment elements 10; and a carrying platform 319 for carrying the upper securing portion 354 of the locking element 30.

In the example, the first guiding slot 314 is interrupted between the supportive platform 313 and the carrying platform 319. In another example, the first guiding slot 314 is continuous as long as the guiding elements provide a passage for the actuating arm to pass through and to abut against the supportive platform 313.

Figure 4:
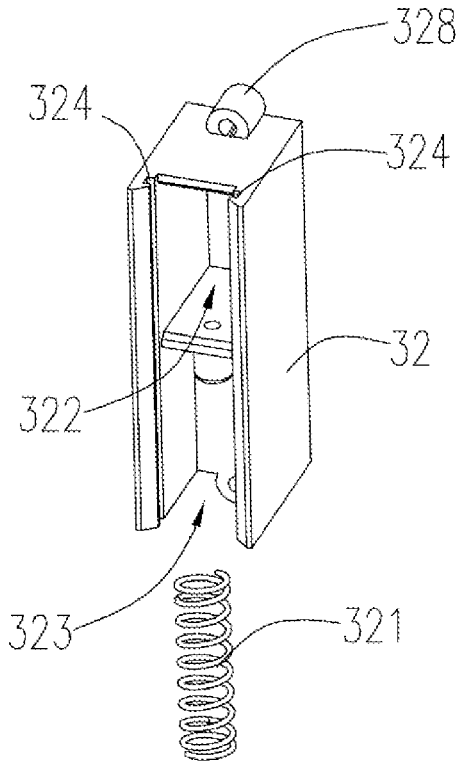
FIG. 4 shows a schematic view of an exemplary lower guiding element.
Figure 5:
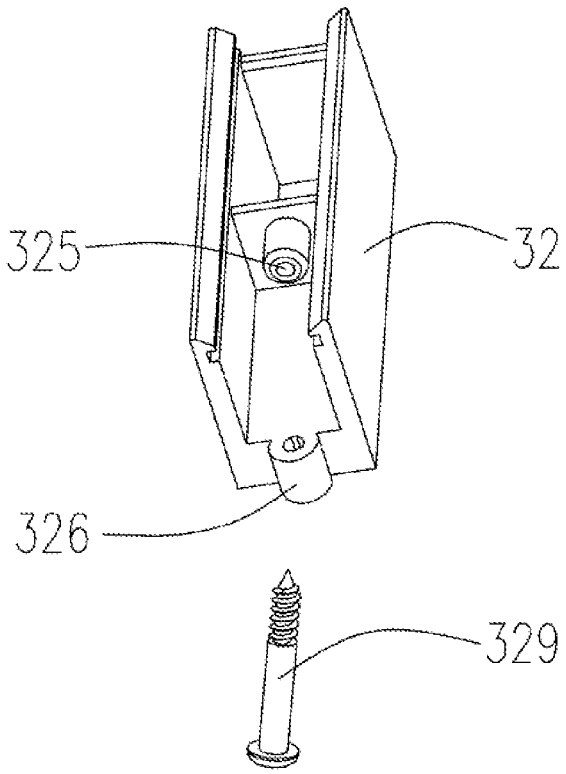
FIG. 5 shows the lower guiding element of FIG. 4 from another view.
Figure 6:
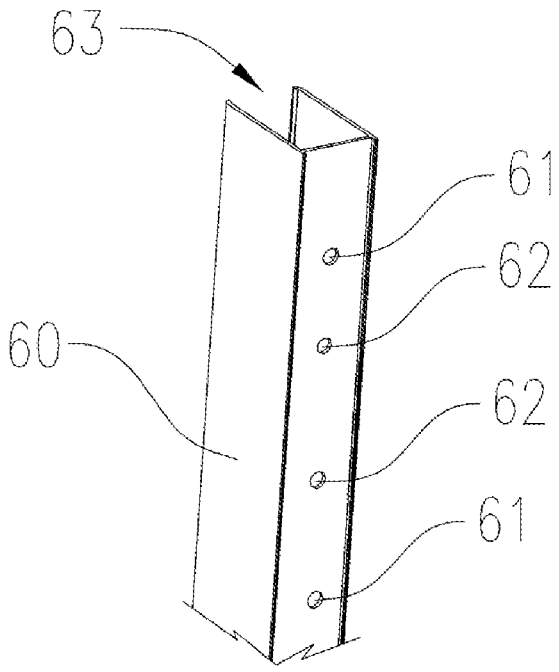
FIG. 6 shows a schematic view of an exemplary stationary frame.

In the example, see FIGS. 4 and 5, the lower guiding element 32 comprises a second guiding slot 324. The locking element 30 is able to slide along the first guiding slot 314 and enters into the second guiding slot 324 and slides therein. The lower guiding element 32 further comprises a second cavity 322 for receiving other of the adjustment element 10, an elastic element 321 for providing elastic force when in contact with the lower securing portion 364, and a third cavity 323 located below the second cavity 322 and having the elastic element 321 received therein. The fixing element 329 passes through the lower securing portion 364 and also the elastic element 321 and is fixed to an upper wall 325 of the third cavity 322. In the example, the elastic element 321 is a spring.

The upper and lower guiding elements 31, 32 are connected to the stationary frame by suitable methods. In the example, see FIGS. 2 to 5, the upper and lower guiding elements 31, 32 each has linkage elements 316, 318 and 326, 328 respectively. A plurality of threaded holes are provided at bottom side of the stationary frame 60, wherein a threaded hole 62 is position in corresponding to the linkage elements such as 316, 318, such that the guiding elements 31, 32 are connected to a space 63 of the stationary frame 60 by fasteners.

Figure 17:
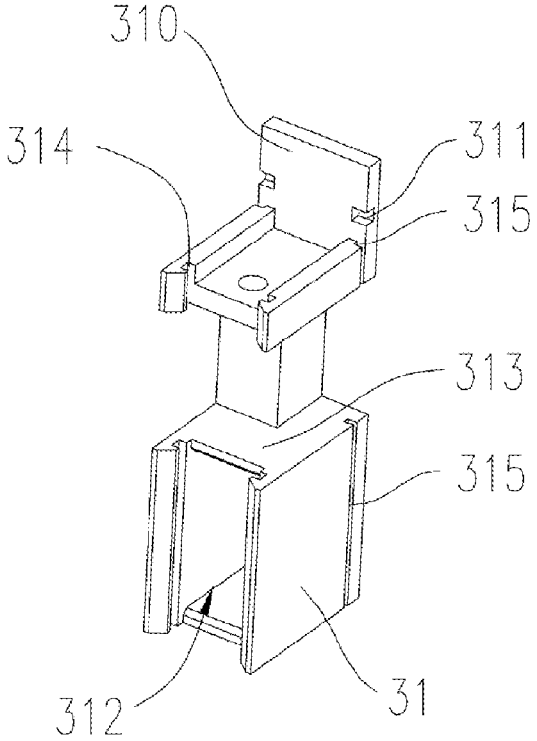
FIG. 17 shows another exemplary upper guiding element of the present invention.
Figure 18:
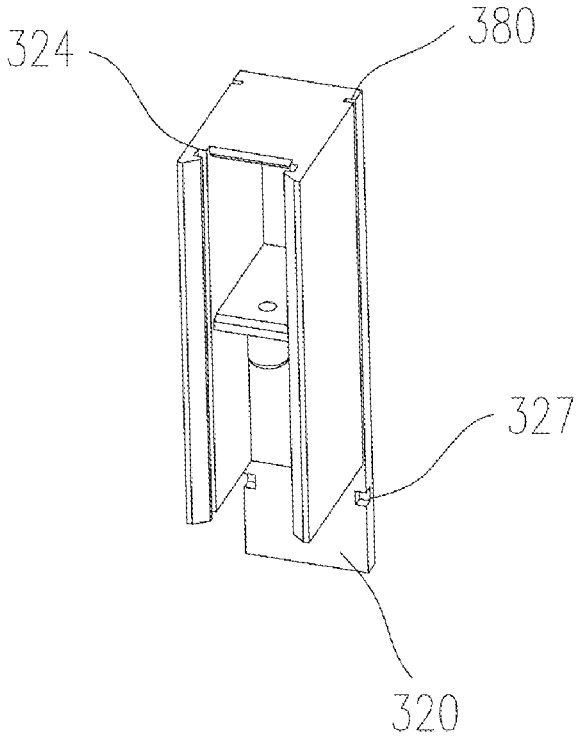
FIG. 18 shows another exemplary lower guiding element of the present invention.
Figure 19:
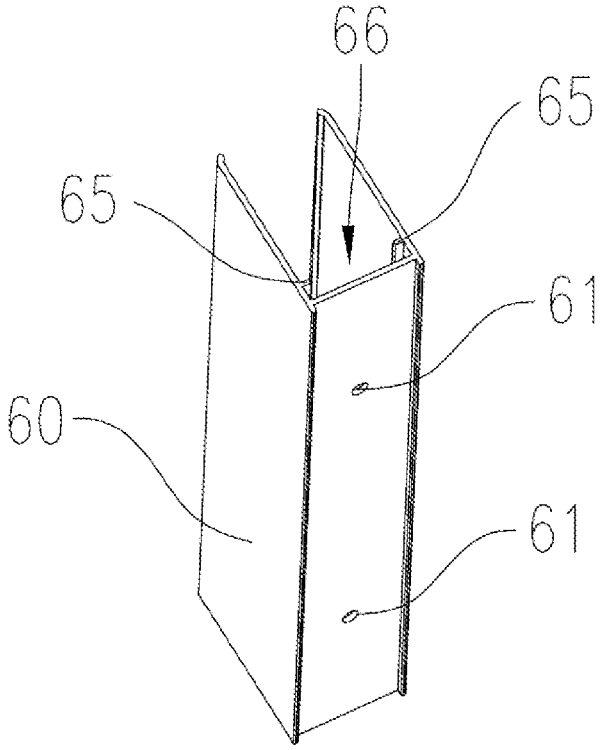
FIG. 19 shows another exemplary stationary frame of the present invention.

In another example, with reference to FIGS. 17-19, the upper guiding element 31 has an extension 310 where at least one locking recess 311 is provided. Between the extension 310 and the carrying platform 319 and also on the supportive platform 313 are formed with locking slots 315, with the locking recess 311 adjacent the path of the locking slots 315. Similarly, the lower guiding element 32 has an extension 320 where at least one locking recess 327 is provided. On the lower guiding element 32 is formed with a locking slot 380, with the locking recess 327 adjacent the path of the locking slot 380. The stationary frame 60 has a guiding groove 66 defined by two ridges 65 which are able to insert into the locking slots 315, 380, such that the upper and lower guiding elements 31, 32 can slide along the stationary frame 60. When the guiding elements 31, 32 is suitably positioned, the ridges 65 will be pressed by a tool (such as a screw driver) in alignment with the recesses 311, 327, so that the ridges will be deformed and forced into the recesses. The guiding elements 31, 32 will then be prevented from sliding and connected to the stationary frame 60.

The stationary frame 60 can be attached to a suitable surface, such as a wall surface, by suitable methods. In the example, threaded holes 61 are provided at the bottom side of the frame 60 such that the frame can be attached to the wall surface by fasteners. The person skilled in the art will know other ways to achieve the attachment.

With reference again to FIGS. 1 and 7, in the example, the locking element 30 further comprises one or more intermediate locking portions 34, each comprises a first through hole 341 and a second through hole 342 in communication therewith. The first through hole 341 has a dimension greater than or equal to that of the end surface 102 of the adjustment element 10. The second through hole 342 has a dimension less than that of the end surface 102.

Correspondingly, the guiding device further comprises one or more intermediate guiding elements 37, each preferably having same structures as the upper guiding element 31.

For purpose of standardization, each of the upper locking portion 35, lower locking portion 36 and possibly existed intermediate locking portions 34 further comprises a third through hole 353, 343 or 363 which is in communication with the first through hole 351, 341, 361 and symmetrically positioned with respect to the second through hole 352, 342, 362 about the first through hole 351, 341,361. The third through hole 353, 343, 363 has a dimension less than that of the end surface 102 and preferably same as that of the second through hole 352, 342, 362.

In the example, the upper guiding element 31 has a spacer 317 arranged between the supportive platform 313 and the carrying platform 319, such that the upper guiding element 31 has a height matching with that of the locking element 30.

Figure 8:
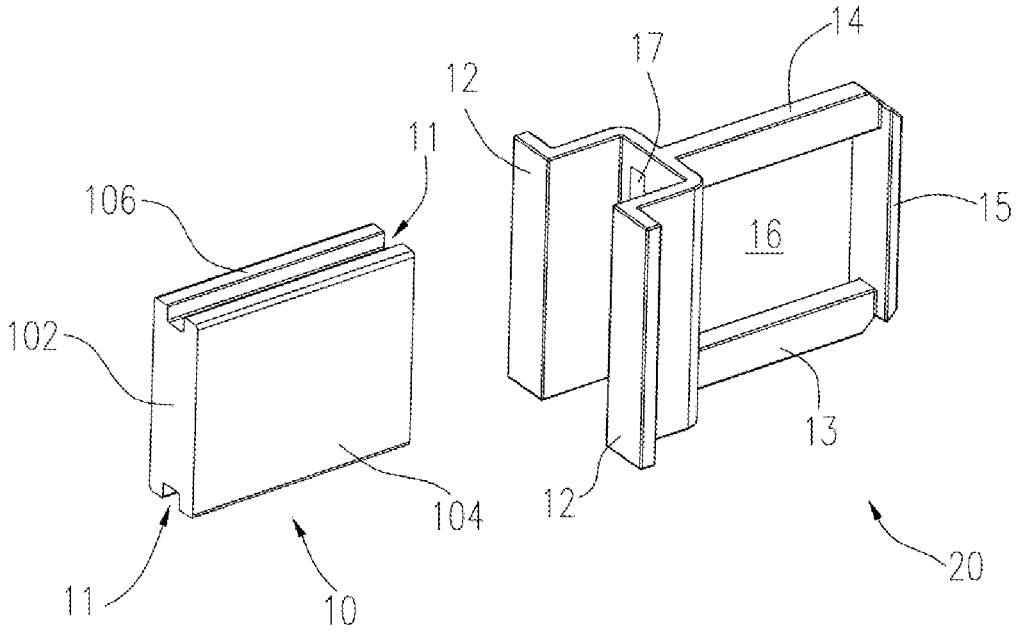
FIG. 8 is an exploded view of an exemplary adjustment device.

With reference to FIG. 8, it is shown an exemplary adjustment device which comprises the adjustment element 10 and a carrier element 20 carrying the element 10. The adjustment element 10 has a smooth side surface 104, exposed when loaded on the carrier element 20.

The adjustment element 10 has end surfaces 102, a top surface 106 and a bottom surface (not shown). In the example, at least one of the top surface and the bottom surface is provided with a sliding groove 11. In other examples, the sliding groove can also be absent.

The carrier element 20 comprises connection wings 12 for connecting to a movable frame 50 (FIG. 10), an upper loading frame 14 connecting to the connection wings 12, a lower loading frame 13 in parallel with the upper loading frame 14 and in connection with the connection wings 12, and an opening 17 which, together with the upper and lower loading frames 14, 13, defines a space 16 for receiving the adjustment element 10.

In the example, a portion of at least one of the upper and lower frames 14, 13 forms a guiding rail for engaging within the sliding groove 11 such that the adjustment element 10 can be stably received within the space 16.

In other examples, when the adjustment element 10 is not provided with the sliding groove 11, the adjustment element 10 has a height slightly greater than that of the opening 17, such that the adjustment element 10 can be received in the space 16 by virtue of its flexibility.

In the example, the adjustment element 10 has a length equal to that of the space 16. In other examples, the adjustment element 10 has a length slightly smaller/greater than that of the space 16.

In the example, the carrier element 20 further comprises a front blocking plate 15 connecting with the free ends of the upper and lower loading frames 14, 13, respectively, in order to prevent the adjustment element 10 from moving outside the space 16. When the adjustment element 10 is received in the space 16, one of the end surfaces 102 is in contact with the front blocking plate 15. In other examples, the front blocking plate 15 may be absent.

Figure 9:
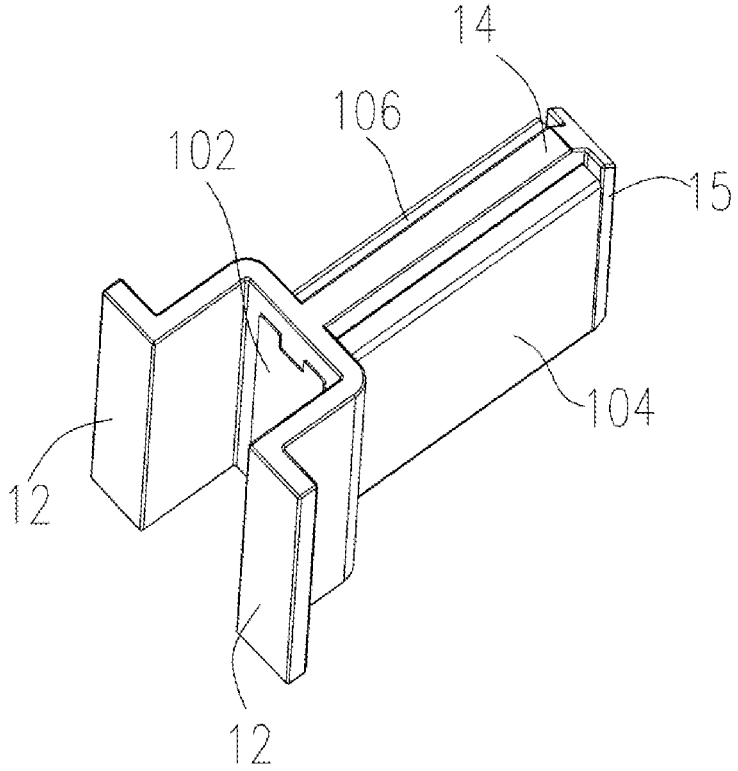
FIG. 9 shows the adjustment device of FIG. 8 in assembly state.

With reference to FIG. 9, it is shown the adjustment element 10 and the carrier element 20 when assembled. As shown, when the adjustment element 10 is loaded on the carrier element 20, the two side surfaces 104 of the adjustment element 10 are exposed outside. The top surface 106 is in contact with the top loading frame 14, and one of the end surfaces 102 abuts against the front blocking plate 15, and the other end surface 102 is accommodated in the opening 17.

Figure 10:
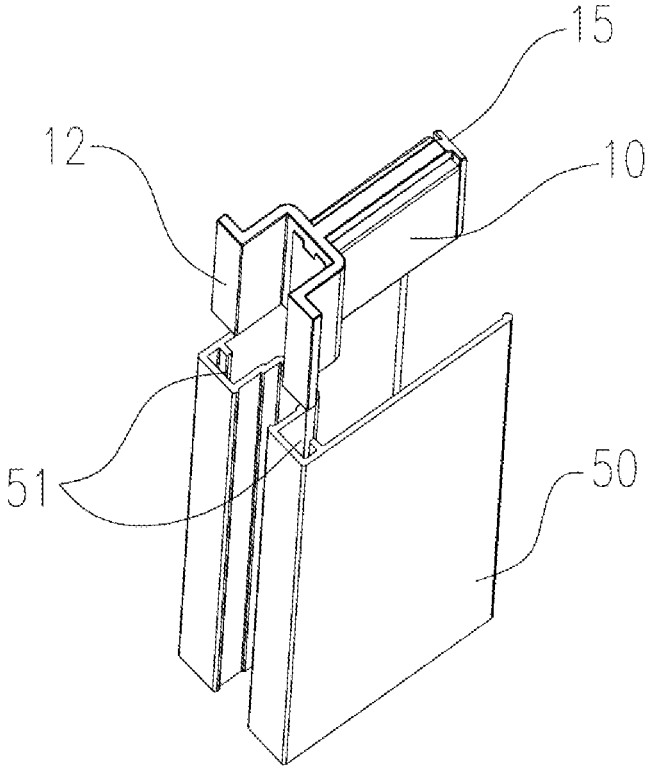
FIG. 10 schematically shows the assembly of an exemplary adjustment device and an exemplary movable frame.

FIG. 10 shows the assembly of the adjustment device with an exemplary movable frame 50. The movable frame 50 is provided with a receiving groove 51 into which the wings 12 can be inserted so that the whole adjustment device can be attached to the movable frame 50 and slide along the groove 51.

Figure 11:
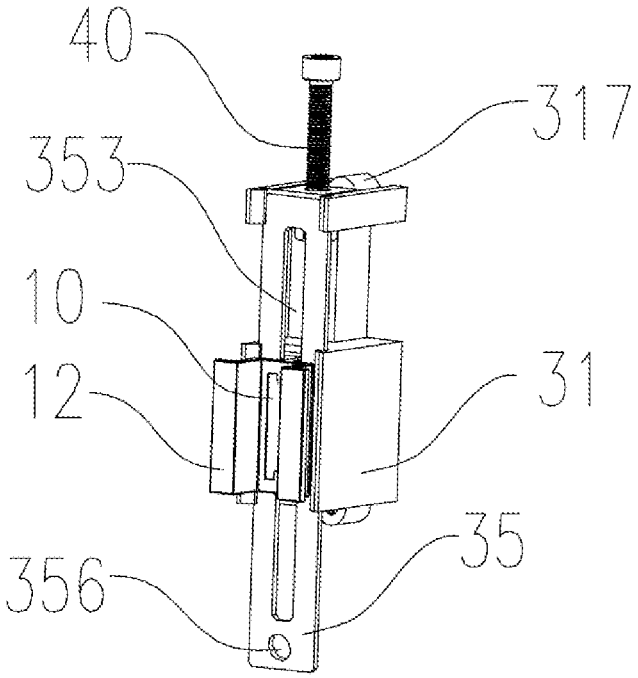
FIG. 11 schematically shows the assembly of an exemplary adjustment device and a locking device, wherein the adjustment device is not locked.

FIG. 11 shows the assembly of one adjustment device, the upper locking portion 35 and the upper guiding element 31. As shown, the adjustment device passes through the first through hole 351 and into the first cavity 312 of the upper guiding element 31. The upper locking portion 35 is inserted into the first guiding slot 314. The actuating arm 40 (a threaded rod in this example) passes through the upper securing portion 354 and the through hole 316 of the carrying platform 319 and then abuts against the supportive platform 313. In the state as shown, the adjustment device can pass through the first through hole 351 and the first cavity 312 freely, so the position and angle of the movable frame 50 can be adjusted freely in relative to the stationary frame 60.

Figure 12:
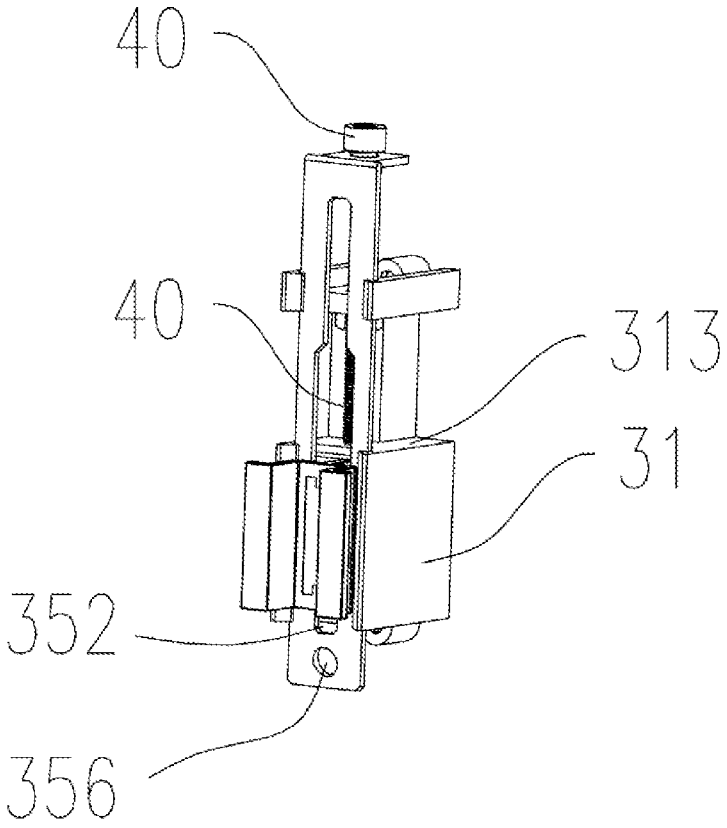
FIG. 12 schematically shows the assembly of an exemplary adjustment device and a locking device, wherein the adjustment device is locked.

FIG. 12 shows that the adjustment device is forced into the second through hole 352 such that it is locked. Specifically, when the position of the movable frame 50 in relation to the stationary frame 60 is determined, by rotation of the actuating arm 40, the upper locking portion 35 will move upward due to counterforce, because the actuating arm 40 has one terminal end abutting against the supportive platform 313 and thus cannot move downward. However, the first cavity 312 is not able to move upward, the adjustment device therefore will be forced into the second through hole 352.

In the present invention, the adjustment element 10 is generally made from flexible materials, such as rubbers, PU or modified PU, while the locking device is generally made of rigid materials, for example engineered plastics such as polyformaldehyde or Nylon 66, or Zinc alloy. Therefore, the adjustment element 10 can be forced into the second through hole 352 by application of forces. When forced into the second through hole 352, the adjustment device will be unable to move in relative to the stationary frame 60. Therefore, relative position between the movable frame 50 and the stationary frame 60 is fixed.

Figure 13:
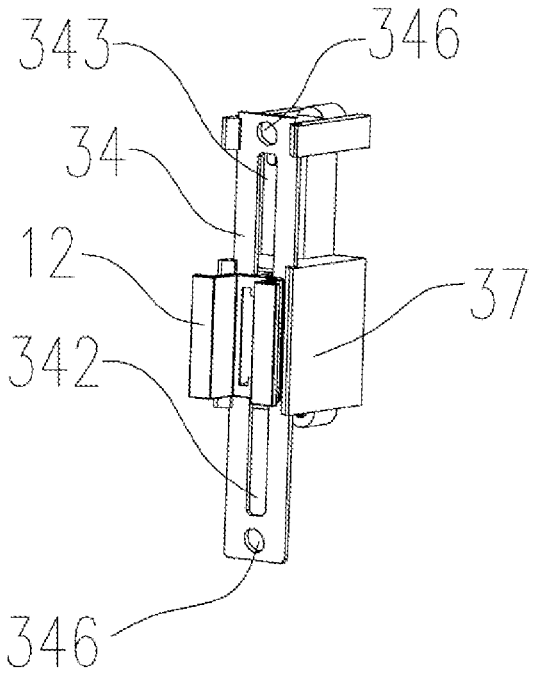
FIG. 13 schematically shows the assembly of another exemplary adjustment device and a locking device, wherein the adjustment device is not locked.
Figure 14:
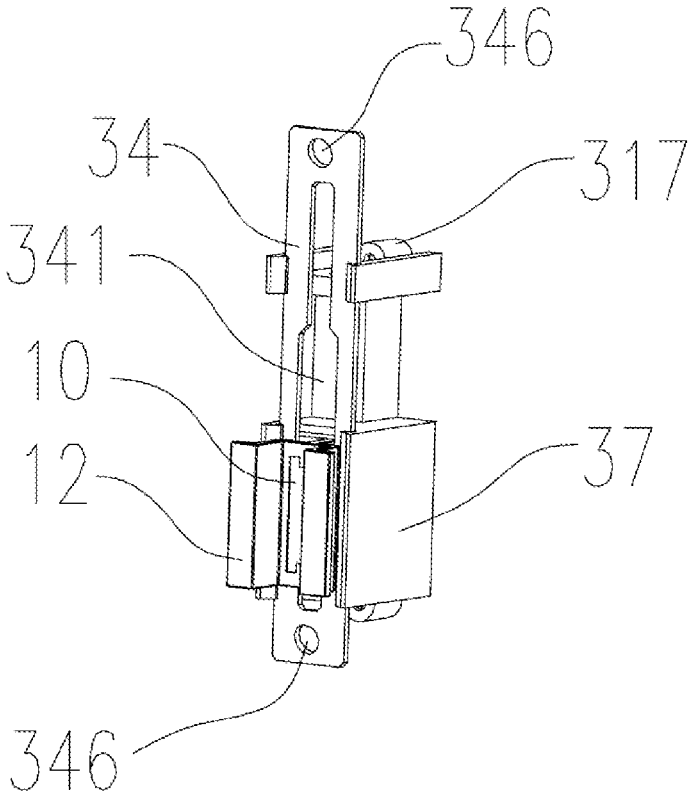
FIG. 14 schematically shows the assembly of another exemplary adjustment device and a locking device, wherein the adjustment device is locked.

FIGS. 13 and 14 show the assembly of an adjustment device with an intermediate locking portion 34 and an intermediate guiding element 37. The locking of the adjustment device by the locking portion 34 is similar to that as shown in FIGS. 11 and 12, except that the intermediate locking portion 34 does not need additional actuating arm 40, but instead, is moved upward by virtue of the linkage element 33 or along with the upper locking portion 35 when formed into one piece therewith.

Figure 15:
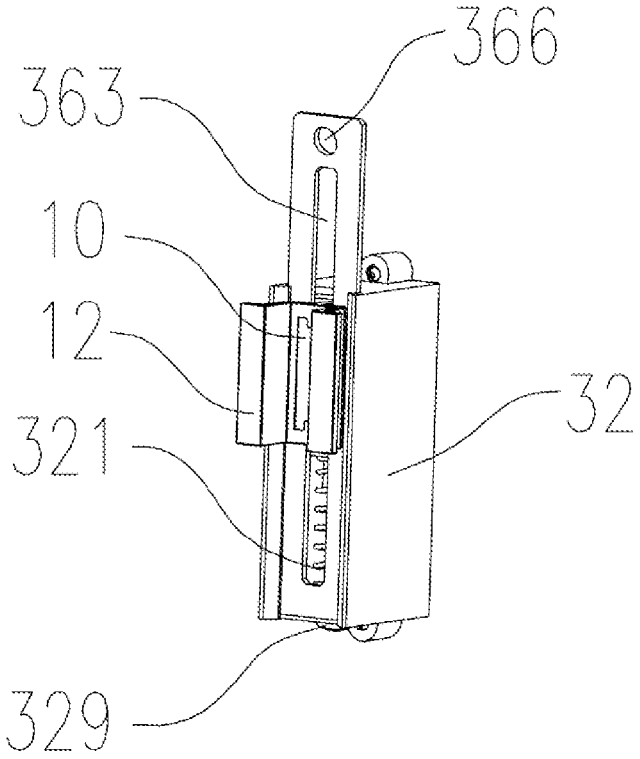
FIG. 15 schematically shows the assembly of yet another exemplary adjustment device and a locking device, wherein the adjustment device is not locked.
Figure 16:
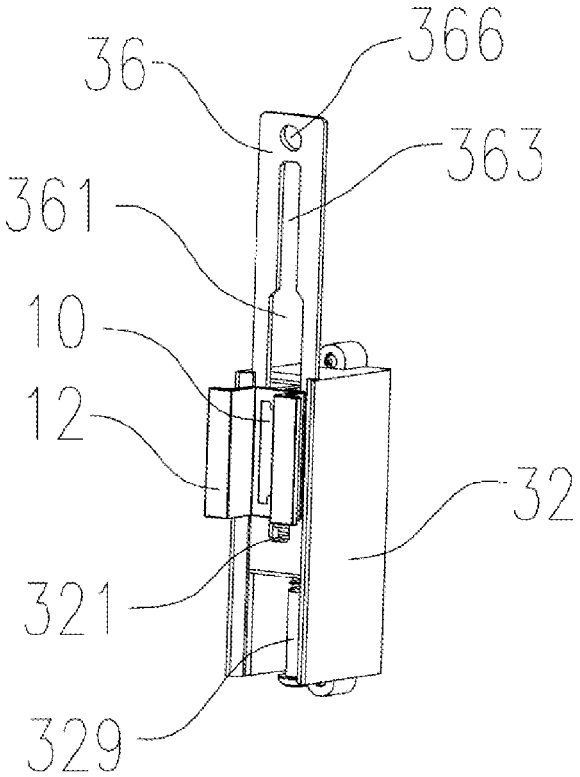
FIG. 16 schematically shows the assembly of yet another exemplary adjustment device and a locking device, wherein the adjustment device is locked.

FIGS. 15 and 16 show the assembly of an adjustment device with the lower locking portion 36 and the lower guiding element 32. In FIG. 15, the adjustment device can pass the first through hole 361 and the second cavity 322 freely, so that the position and angle of the movable frame 50 can be freely adjusted in relation to the stationary frame 60. As shown, the elastic element 321 is in its relaxed or slightly compressed state. By similar principle as that shown in FIGS. 11 and 12, the adjustment device is locked by the lower locking portion 36, except that the lower locking portion 36 does not need additional actuating arm 40, but instead, is moved upward by virtue of the linkage element 33 or along with the upper locking portion 35 when formed into one piece therewith. In the locked state, the elastic element 321 is in its compressed state due to the upward movement of the lower locking portion 36.

When the relative position between the movable frame 50 and the stationary frame 60 needs to be changed, by contrarotation of the actuating arm 40, the whole locking device is pushed to move downward along the first and second guiding slots 314, 324 due to the elastic force of the elastic element 321, such that the adjustment device is released from the second through hole 352, 342, 362 and returns back to the first through hole 351, 341, 361 where the adjustment device can freely move again.

It should be understood that various example embodiments have been described with reference to the accompanying drawings in which only some example embodiments are shown. The present invention, however, may be embodied in many alternate forms and should not be construed as limited to only the example embodiments set forth herein.

The invention claimed is:

1. A shower door assembly with linkage control comprising a stationary frame, a movable frame and an adjustment assembly disposed between the stationary frame and the movable frame, the adjustment assembly comprising at least two adjustment devices and locking devices for locking each of the adjustment devices, characterized in that, each of the locking devices comprises a locking element having an upper locking portion and a lower locking portion, the upper and lower locking portions each comprising a first through hole having a dimension greater than or equal to a dimension of an end surface of corresponding adjustment device and a second through hole having a dimension smaller than the dimension of the end surface of the corresponding adjustment device and in communication with the first through hole, the upper locking portion further comprising an upper securing portion and an actuating arm, the actuating arm passing through the upper securing portion, the lower locking portion further comprising a lower securing portion and a fixing element, the fixing element passing through the lower securing portion; and a guiding device having an upper guiding element and a lower guiding element, the upper guiding element comprising a first guiding slot along which the locking element is able to slide, a supportive platform for supporting the actuating arm, a first cavity for receiving one of the at least two adjustment devices, and a carrying platform for carrying the upper securing portion of the locking element, the lower guiding element comprising a second guiding slot along which the locking element is able to slide, a second cavity for receiving an other of the at least two adjustment devices, an elastic element for providing elastic force when pressed against the lower securing portion, and a third cavity located lower with respect to the second cavity and having the elastic element received therein, the fixing element passing through the lower securing portion and the elastic element and fixing to an upper wall of the third cavity.

2. The shower door assembly of claim 1, characterized in that, the upper and lower locking portions are formed in one piece, or the upper and lower locking portions are detachably connected to each other by a linkage element.

3. The shower door assembly of claim 2, characterized in that, each of the upper locking portion and the lower locking portion further comprises a third through hole in communication with the first through hole and symmetrically disposed with respect to the second through hole about the first through hole, the third through hole having a dimension smaller than the dimension of the end surface of the corresponding adjustment device.

4. The shower door assembly of claim 1, characterized in that, the locking element further comprises one or more intermediate locking portions, each of the intermediate locking portions comprising a first through hole and a second through hole in communication with the first through hole, the first through hole having a dimension greater than or equal to a dimension of an end surface of the corresponding adjustment device, the second through hole having a dimension smaller than the dimension of the end surface of the corresponding adjustment device, and correspondingly, the guiding device further comprising one or more intermediate guiding elements, each having the same structure as the upper guiding element.

5. The shower door assembly of claim 4, characterized in that, each of the intermediate locking portions further comprises a third through hole in communication with the first through hole and symmetrically disposed with respect to the second through hole about the first through hole, the third through hole having a dimension smaller than the dimension of the end surface of the corresponding adjustment device.

6. The shower door assembly of claim 1, characterized in that, the adjustment device comprises an adjustment element and a carrier element bearing the adjustment element, the adjustment element having side surfaces exposed for engaging with the locking device.

7. The shower door assembly of claim 6, characterized in that, the carrier element comprises connection wings for connecting to the movable frame, an upper loading frame connecting to the connection wings, a lower loading frame in parallel with the upper loading frame and in connection with the connection wings, and an opening which, together with the upper and lower loading frames, defines a space for receiving the adjustment element.

8. The shower door assembly of claim 7, characterized in that, the carrier element further comprises a front blocking plate connecting with free ends of the upper and lower loading frames respectively.

9. The shower door assembly of claim 8, characterized in that, the adjustment element further comprises end surfaces, a top surface and a bottom surface, with one of the end surfaces in contact with the front blocking plate, at least one of the top and bottom surfaces being provided with a sliding groove, and a portion of at least one of the upper and lower frames forming a guiding rail for engaging within the sliding groove such that the adjustment element can be stably received within the space.

10. The shower door assembly of claim 7, characterized in that, the adjustment element has a height greater than that of the opening, such that the adjustment element can be received in the space by virtue of its flexibility.

* * * * *